US010119508B2

(12) United States Patent
Millet

(10) Patent No.: US 10,119,508 B2
(45) Date of Patent: Nov. 6, 2018

(54) COVER OF AN INTERNAL COMBUSTION ENGINE ASSEMBLY HAVING A COMMON RAIL, ENGINE ASSEMBLY AND AUTOMOTIVE VEHICLE INCLUDING SUCH A COVER

(71) Applicant: VOLVO TRUCK CORPORATION, Göteborg (SE)

(72) Inventor: Guillaume Millet, Luzinay (FR)

(73) Assignee: Volvo Truck Corporation, Göteborg (SE)

( * ) Notice: Subject to any disclaimer, the term of this patent is extended or adjusted under 35 U.S.C. 154(b) by 82 days.

(21) Appl. No.: 15/103,857

(22) PCT Filed: Dec. 13, 2013

(86) PCT No.: PCT/IB2013/003196
§ 371 (c)(1),
(2) Date: Jun. 11, 2016

(87) PCT Pub. No.: WO2015/087105
PCT Pub. Date: Jun. 18, 2015

(65) Prior Publication Data

US 2016/0319786 A1 Nov. 3, 2016

(51) Int. Cl.
*F02B 77/00* (2006.01)
*F02M 55/02* (2006.01)
(Continued)

(52) U.S. Cl.
CPC ..... *F02M 55/025* (2013.01); *F02F 1/24* (2013.01); *F02F 11/002* (2013.01); *F02M 61/14* (2013.01);
(Continued)

(58) Field of Classification Search
CPC ..... F02F 11/002; F02F 1/24; F02M 2200/18; F02M 55/025; F02M 61/14; F02M 69/465
(Continued)

(56) References Cited

U.S. PATENT DOCUMENTS 3,521,726 A * 7/1970 Fritz ..... F02B 77/13 123/195 C
4,669,443 A * 6/1987 Oetting ..... F02P 7/02 123/143 C
(Continued)

FOREIGN PATENT DOCUMENTS

DE 19915792 A1 10/2000
EP 0922852 A2 * 6/1999 ..... F02M 55/001
(Continued)

OTHER PUBLICATIONS

International Search Report (dated Aug. 7, 2014) for corresponding International App. PCT/IB2013/003196.

*Primary Examiner* — Marguerite McMahon
*Assistant Examiner* — Tea Holbrook
(74) *Attorney, Agent, or Firm* — WRB-IP LLP

(57) ABSTRACT

A cover for an internal combustion engine assembly that includes a pressurized fuel accumulator feeding fuel to at least one injector is provided, the cover defining, with a cylinder head, a volume designed to receive the common rail and the injector. The cover borders a first sub-volume, designed to receive the injector, and a second sub-volume separated from the first sub-volume by a separation wall of the cover and designed to receive the common rail. The cover includes a frame to be fitted on the cylinder head and a cap removably fitted on the frame. The separation wall is designed for the passage of a fuel connection connecting the injector to the common rail.

15 Claims, 2 Drawing Sheets

(51) Int. Cl.

| | |
|---|---|
| ***F02M 61/14*** | (2006.01) |
| ***F02M 69/46*** | (2006.01) |
| ***F02F 1/24*** | (2006.01) |
| ***F02F 11/00*** | (2006.01) |

(52) U.S. Cl.
CPC ..... *F02M 69/465* (2013.01); *F02M 2200/18* (2013.01)

(58) Field of Classification Search
USPC ..... 123/445, 456, 468, 198 E, 195 C, 193.5
See application file for complete search history.

(56) References Cited

U.S. PATENT DOCUMENTS 5,285,754 A * 2/1994 Bell ..... F01M 13/0416 123/195 C
5,297,523 A * 3/1994 Hafner ..... F02M 47/00 123/446
5,325,834 A * 7/1994 Ballheimer ..... F02B 69/00 123/446
5,392,749 A * 2/1995 Stockner ..... F02M 57/025 123/446
5,499,612 A * 3/1996 Haughney ..... F02M 39/00 123/470
5,533,485 A 7/1996 Bronkal
5,746,168 A * 5/1998 Lochbrunner ..... F02F 7/006 123/195 C
5,957,100 A * 9/1999 Frohwerk ..... F02F 7/006 123/90.37
6,076,505 A * 6/2000 Guggenmos ..... F02F 1/242 123/195 C
6,237,569 B1 * 5/2001 Stelzer ..... F02M 55/02 123/456
6,269,796 B1 * 8/2001 Mitchell ..... F02M 57/025 123/468
6,394,071 B2 * 5/2002 Nitta ..... F02F 7/006 123/456
6,880,528 B2 * 4/2005 Klugl ..... F01M 11/10 123/468
8,915,229 B2 * 12/2014 Kajita ..... F02F 1/24 123/195 C
2002/0112684 A1 * 8/2002 Jones ..... F02F 7/006 123/90.38

FOREIGN PATENT DOCUMENTS

| | | | | |
|---|---|---|---|---|
| EP | 1172551 | A2 | 1/2002 | |
| GB | 2337082 | A | 11/1999 | |
| JP | H08261105 | A | 10/1996 | |
| JP | 2014095314 | A * | 5/2014 | ..... F02M 77/13 |

* cited by examiner

COVER OF AN INTERNAL COMBUSTION ENGINE ASSEMBLY HAVING A COMMON RAIL, ENGINE ASSEMBLY AND AUTOMOTIVE VEHICLE INCLUDING SUCH A COVER

BACKGROUND AND SUMMARY

The invention relates to a cover of an internal combustion engine assembly having a common rail, to an engine including such a cover and to an automotive vehicle including such an engine assembly.

The invention can be applied in heavy-duty vehicles, such as trucks, buses and construction equipments. Although the invention will be described with respect to a truck, the invention is not restricted to this particular vehicle, but may also be used in other automotive vehicles, such as passenger cars, commercial vehicles or construction equipment machines. It can also be used in connection with engine installations used in stationery installations, for example for driving fixed generators or pumps or other fixed equipment.

In the field of internal combustion engines, it is known to have a common rail fuel injection system in order to feed fuel to cylinders. This system comprises pumping element(s) and a common rail or fuel accumulator which feeds fuel to a number of injectors, for example six injectors, each injecting fuel into a cylinder.

The common rail has to be integrated on the engine. Generally, the common rail is located close to the injectors in order to decrease the length of high-pressure pipes connecting the common rail to the injectors. The common rail is also preferably located as close as possible to the pumping elements so that the high-pressure pipes are relatively short.

In a known arrangement, a valve cover, or cylinder head cover, is placed on top of the cylinder head in a fluid tight manner. The injectors, the common rail and the high-pressure pipes are located in the sealed volume defined between the cylinder head and the valve cover.

It is known to locate the common rail inside this sealed volume, so that the potential fuel leakages are contained inside the engine. Consequently, there is no safety risk, but in case of fuel leakage, fuel may be diluted in the oil included in the sealed volume.

Alternatively, the common rail may be located outside the sealed volume, so that the potential fuel leakages do not go in engine oil. However, the fuel leakages may flow down on the road and may also spray in the engine compartment, involving a safety risk.

U.S. Pat. No. 5,533,485 discloses an internal combustion, engine assembly comprising a common rail feeding fuel to injectors. A valve cover defines a closed volume where the injectors are located. The common rail is integrated, partially or completely, in a lateral wall of the valve cover. Pipes for connecting injectors to the common rail pass outside of the valve cover. This design does not allow collecting the fuel leakages due to a failure of such external pipes. Moreover, the maintenance of the common rail requires disassembling the valve cover from the cylinder head and resealing the valve cover on the cylinder head, which is time consuming.

It is desirable to provide means for enclosing the fuel accumulator with a minimum of additional parts, in order to contain fuel leakages and to avoid the dilution of the fuel leakages in the engine oil.

Thanks to an aspect of the invention, the two-piece cover delimitates a closed volume where the common rail, the injectors and the fuel connections between the two are located. Thus, the leakages may be contained in the engine assembly. The cover separates the injectors from the common rail.

The two-piece design of the cover creates two separate sub-volumes with a simplified installation because the fuel connexions between the fuel accumulator and the injector are within the volume and remain attainable during the mounting before the cap is installed to close the volume.

According to further aspects of the invention which are advantageous but not compulsory, such an engine may include one or several of the following features:

- The separation wall may comprise an aperture for the passage of the fuel connection from the first sub-volume to the second sub-volume.
- The aperture may be entirely formed in a portion of the separation wall pertaining to the frame or may be formed at an interface between the frame and the cap. This allows installing the fuel connection with the cap removed.
- The frame may define a first contour bordering the first sub-volume and a second contour bordering the second sub-volume. Those contours may be defined by of beams of the frame.
- The cap may include walls defining a first contour coinciding with the first contour of the frame and a second contour coinciding with the second contour of the frame. When the cap is assembled to the frame, the contours match to create the first and second sub-volumes.
- A height of at least one beam defining the first contour of the frame may be higher than a height of at least one beam defining the second contour of the frame.
- The cap may include a service trap-door opening into the second sub-volume. This allows access to the fuel accumulator without needing to remove neither the cap nor the frame.
- The cap may include an integral cover wall.
- The cap may include a removable cover wall.

The invention also relates to an internal combustion engine assembly including a pressurized fuel accumulator feeding fuel to at least one injector, a cylinder head and a cover having any of the preceding features.

The invention also relates, according to an aspect thereof, to an internal combustion engine assembly comprising a pressurized fuel accumulator feeding fuel to at least one injector, a cylinder head and a cover, the cover defining, with the cylinder head, a volume enclosing the common rail and the injector, and the cover bordering a first sub-volume enclosing the injector, and a second sub-volume separated from the first sub-volume by a separation wall of the cover and enclosing the common rail, characterized in that the cover includes a frame fitted on the cylinder head and a cap removably fitted on the frame, and in that a fuel connection connecting the injector to the common rail passes through the separation wall.

Such internal combustion engine assembly may include one or several of the following features:

- A sealing element may be located between the cylinder head and the frame.
- The separation wall may be extended by an encapsulating element designed to be arranged around the fuel connection, in a configuration where the encapsulating element defines an empty volume around the fuel connection, the empty volume extending the second volume up to a connection zone between a connection port of the injector and the fuel connection.

The connecting element may have the shape of a cylinder having an extremity attached to the connecting port of the injector.

A fuel sensor may be located in the second sub-volume.

A fuel connection may include a pipe having a first portion connected to a connection port of the injector and a terminal portion globally perpendicular to the first portion and connected to the common rail.

The invention also relates to an automotive vehicle including an internal combustion engine assembly having any of the above features.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
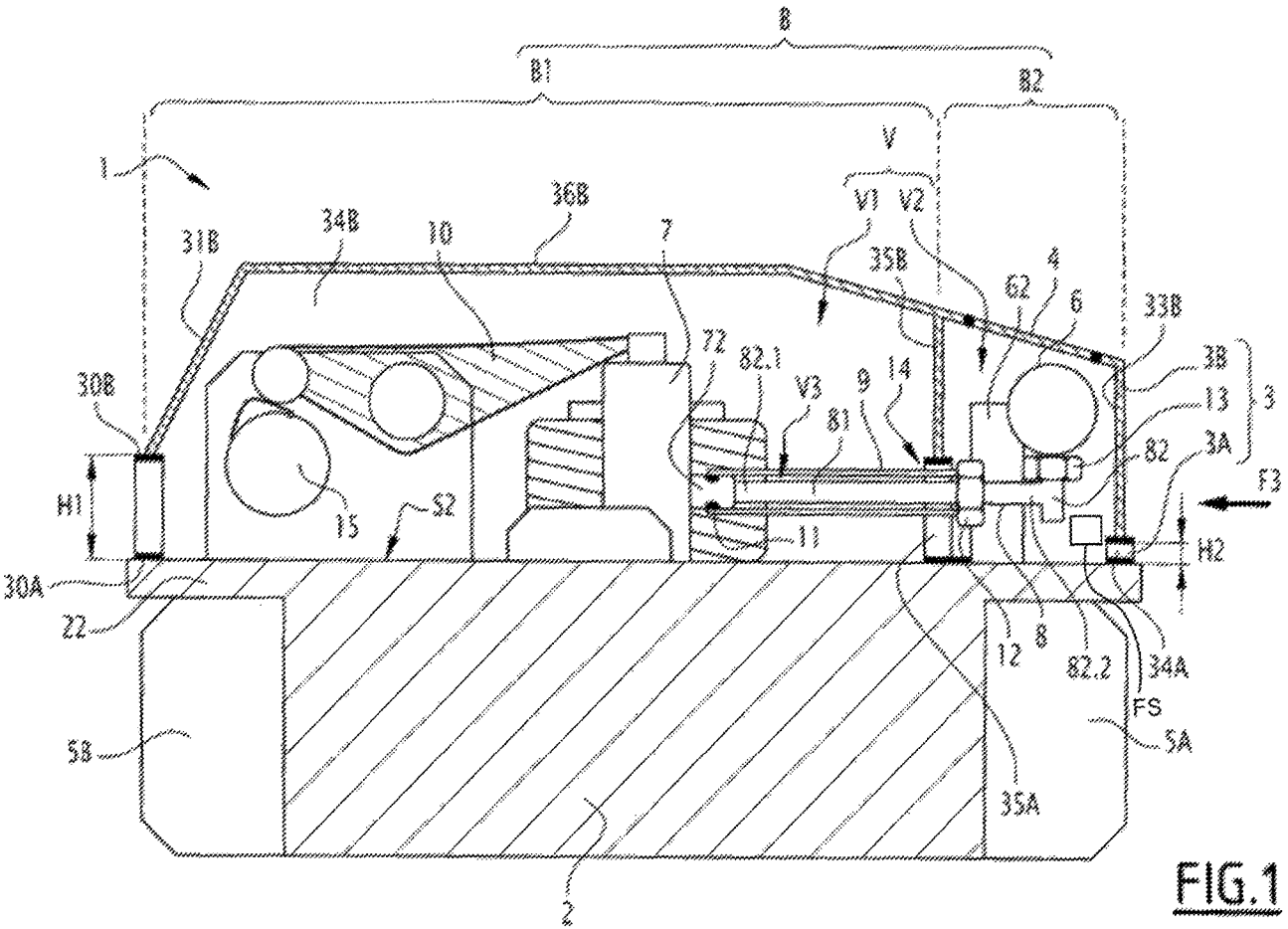
FIG. 1 is a schematic sectional representation of an internal combustion engine assembly according to the invention including a cover.
Figure 2:
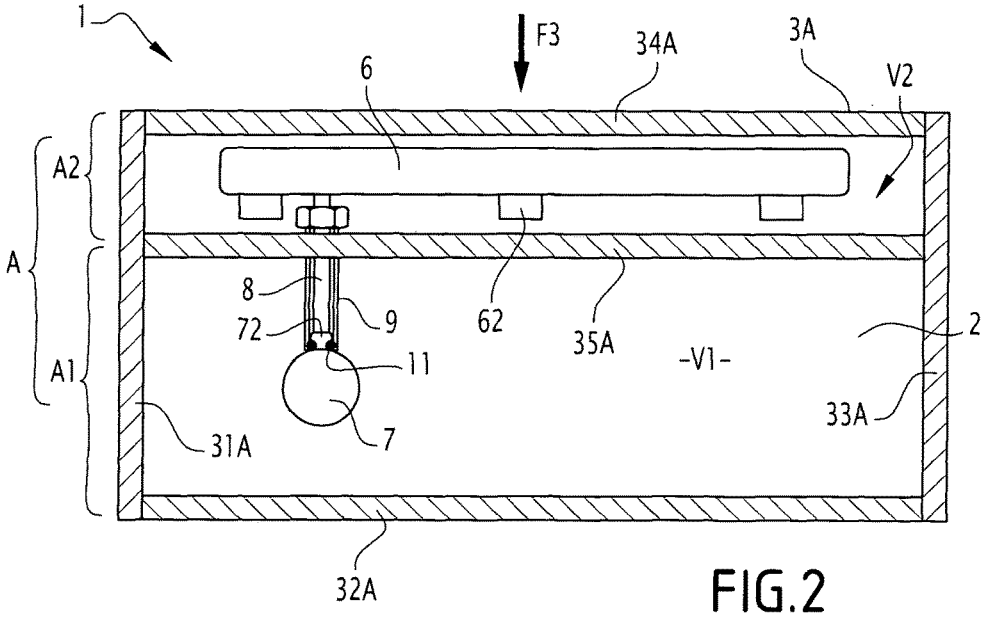
FIG. 2 is a top partial view of the engine assembly of FIG. 1, a cap of the cover being removed.
Figure 3:
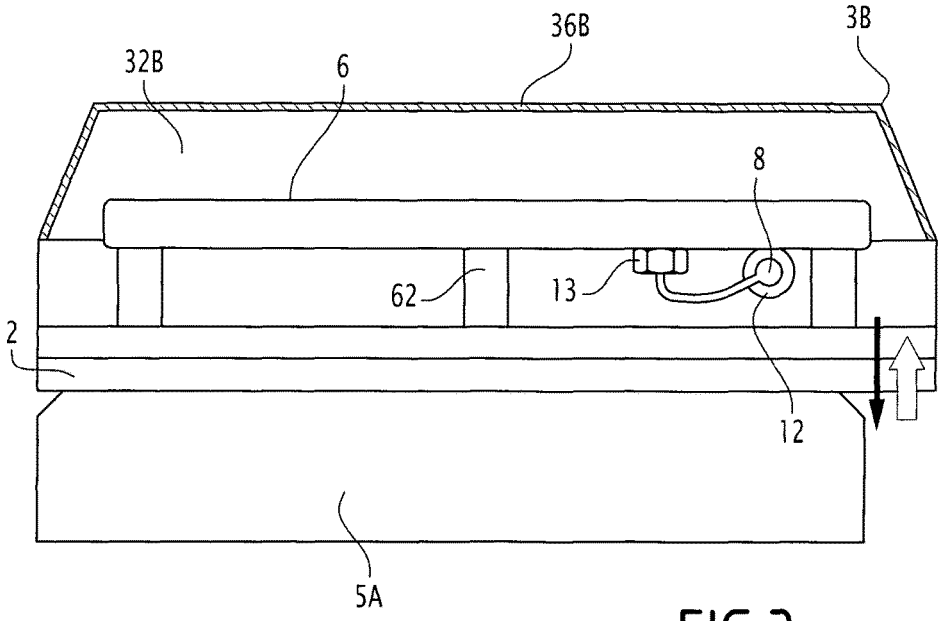
FIG. 3 is a view along arrow F3 on FIGS. 1 and 2, a wall of the cap being removed for clarity.

FIGS. 1 to 3 partially show an internal combustion engine assembly 1, such as a gasoline engine or a diesel engine, including a cylinder head 2 to be fitted on an engine block (not shown). The internal combustion engine assembly may further comprise an inlet manifold 5A for feeding intake gases, including fresh air, and an outlet manifold 5B for collecting exhaust gases. The inlet and/or the outlet manifolds may be fitted to the cylinder head 2, for example each on opposite lateral sides of the cylinder head 2.

The internal combustion engine may be an inline engine having several engine cylinders extending parallel one to the other defining a longitudinal plane. In the following, the longitudinal plane of the engine will be considered to be vertical, and the cylinder head will be considered to be on the top side of the engine, although the engine may be oriented differently with respect to gravity.

The cylinder head 2 is typically fitted on a top surface of the engine block in which are formed one or several cylinders. Each cylinder typically houses a reciprocating piston and is typically opened in the top surface of the engine block. The cylinder head 2 closes the cylinders at their top. The cylinder head may comprise at least one intake port and at least one exhaust port for each cylinder. It may also carry the intake and exhaust valves which control the passage of fluids through those ports. The cylinder head may comprise internal oil passages and/or internal cooling fluid passages. The cylinder head 2 may be of an essentially parallelepiped shape and may comprise a lower surface, which rests on the top surface of the engine block, and a top surface S2, substantially parallel to the lower surface. In the shown example of FIG. 1, the cylinder head may comprise one or several extension decks 22 which extend the top surface S2 of the cylinder head transversally. The decks 22 are of reduced thickness compared of the main portion of the cylinder head and may therefore extend as overhangs, for example over the intake and/or the exhaust manifolds.

The cylinder head 2 may also carry at least part of the valve actuation mechanism, which may comprise for example one or several camshafts 15 cooperating with rocker arms 10 which drive the opening and the closure of intake and exhaust valves for the passage of intake and exhaust gases towards and from of the engine cylinders. The valve actuation mechanism may be fitted on the top surface S2 of the cylinder head 2. Each engine cylinder may be equipped with a fuel injector 7, for injecting fuel directly into the cylinder. On FIG. 2, only one injector is shown for the sake of clarity.

The injectors 7 are installed on the cylinder head 2. An injector may comprise a body having a lower portion which is fitted through the cylinder head so that a lower extremity thereof may extend below the lower surface of the cylinder head, to inject fuel inside the corresponding cylinder. The injector 7 may comprise an upper body portion which extends above the level of the top surface of the cylinder head. An injector may comprise a high-pressure connection port 72 by which it receives fuel. The high pressure connection port 72 may be arranged on the upper body portion of the injector, so as to be located outside of the cylinder head 2, above the level of its top surface.

A fuel supply circuit comprising a pressurized fuel accumulator, for example a common rail 6, feeds fuel to each injector 7. In the case of a high pressure injection system, the nominal fuel pressure in the fuel accumulator 6 is a high pressure which can be higher than 100 bars for a gasoline engine, and higher than 1000 bar for a diesel engine.

The common rail 6 may be fitted by means of brackets 62 on the engine, for example on the cylinder head 2. In the embodiment of the drawings, the common rail 6 is fitted on one of the deck portions 22 of the cylinder head.

Fuel is transferred from the fuel accumulator 6 to the injector body 7 through a fuel connection. The fuel connection typically comprises the connection port 72 on the injector body 7, a connection port on the fuel accumulator 6, and at least one high pressure fuel pipe 8 which is connected to both connection ports to fluidically link the accumulator 6 to the connection port 72 of each injector 7, allowing fuel contained in the accumulator 6 to be fed to the injector 7. The engine assembly may have a separate fuel connection for each injector 7.

A cover 3 is fitted on the cylinder head so as to cover at least a main portion of the top surface S2, preferably including the deck portions 22, and delimitates a volume V with the cylinder head 2. The volume V is preferably closed so as to limit or inhibit leakage of oil outside of the volume. Indeed, many components which are accommodated in this volume V, such as for example a valve train, need to be lubricated.

Preferably, the cover 3 is sealed on the cylinder head 2 and the volume V is a sealed volume where no oil leakage occurs towards the exterior.

The cover 3 includes a frame 3A to be fixed to the cylinder head 2, preferably in a sealed manner allowing no oil leakage at the frame/cylinder head interface. The frame 3A is a first element of the cover 3 which delimitates the sides of the volume V. The frame may typically rest on the top surface S2 of the cylinder head. It may be bolted on the cylinder head 2, or fitted with any other type of dismountable fastener.

A sealing element 30A is preferably installed between the cylinder head 2 and the frame 3A.

As in the shown embodiment, the frame 3A may comprise for example four beams 31A, 32A, 33A and 34A forming, in a horizontal plane, a first closed contour A. In the shown embodiment the beams extend horizontally and are connected two by two to from a rectangle, and they exhibit a certain height along the vertical direction so that the frame 3A extends vertically upwards from the top surface of the cylinder head 2. The height of the frame may for example range between 5 to 100 millimeters. The contour A may correspond to the contour of the top surface 2 of the cylinder head.

In the shown example, the frame 3A comprises a fifth beam 35A which extends within the first contour A and is arranged parallel to two parallel longitudinal opposed beams 32A and 33A of the first contour A which extend parallel to the longitudinal plane of the engine. In the example, the fifth beam 35A, which can be called separation beam, is connected to the two opposed transverse beams of the first contour A which extend transversally, perpendicularly to the longitudinal plane of the engine. The first rectangular contour A is thereby divided into two internal closed contours A1 and A2 by the beam 35A. The contour A1 is bordered by the beams 31A, 32A, 33A and 35A, and the contour A2 is bordered by the beams 31A, 35A, 33A and 34A. The frame 3A includes a lower surface S3A in contact with the cylinder head 2, preferably through sealing element 30A. The lower surface S3A is defined by each beam 3A to 34A.

A cap 3B of the cover 3 is removably fitted on the frame 3A so as to close the sealed volume V. A sealing element 30B is installed between the frame 3A and the cap 3B. The cap 3B is a second element of the cover 3. The cap 3B may be for example bolted, either on the frame 3A, or directly on the cylinder head 2, or on both. However, other dismountable fasteners could be used to attach the cap 3B on the engine.

The frame 3A and the cap 3B together delimitate, with the cylinder head 2, the volume V.

The frame 3A includes an upper surface S'3A in contact with the cap 3B, preferably through sealing element 30B. The upper surface S'3A is defined by each beam 31A to 34A.

The cap 3B may include four lateral walls 3B, 32B, 33B and 34B forming a second closed contour B coinciding with the first contour A. In the shown embodiment, the lateral walls 31B, 32B, 33B and 34B therefore extend either longitudinally or transversally as the beams; and they may have a certain height along the vertical direction. The lateral walls 31B, 32B, 33B and 34B are intended to be installed and sealed on the corresponding beams 31A, 32A, 33A and 34A. Another wall, hereinafter called partition 35B, corresponding to the fifth beam 35A, extends within the second contour B and is arranged parallel to the walls 32B and 33B. The second contour B is divided into two internal contours B1 and B2 by the partition 35B, the contour B1 Being delimited by the walls 31B, 32B, 33B and the partition 35B, and the contour B2 being delimited by the walls 31B, 33B and 34B and the partition 35B. The contours B1 and B2 of the cap 3B coincide with the contours A1 and A2 of the frame 3A. The lateral walls may be oblique with respect to the vertical direction.

A top cover wall 36B of the cap 3B, which extends preferentially along a substantially horizontal plane and which is assembled on the walls/partition 31B to 35B in a fluid tight manner, allows the cap to close the volume V opposite the cylinder head 2.

The cover wall 36B may be integral with the cap 3B or removably fitted on the walls/partition 3B to 35B. In an embodiment of the invention, the cap 3B may be a single piece, which means that the cover wall 36B is integral with the walls/partition 31B to 35B. Alternatively, the cover wall 36B may be removably fitted on the walls 31B to 35B.

Alternative designs for the cap 3B may be considered. For example, the cap 3B may be roughly flat, with essentially no walls, so that the cap 3B would comprise essentially the top cover wall 36B intended to sit directly on the upper surface of the frame 3A, preferably in a sealed manner. In this case, the height H1 of the flame 3A should preferably be equal or higher to the height of the injection system located in the volume V.

The sealed volume V is thus divided into two sealed sub-volumes V1 and V2, the first sub-volume V1 Being located inside the contours A1 and B1 and the second sub-volume V2 being located inside the contours A2 and B2. The sealed sub-volumes V1 and V2 are thus contained within the volume V defined between the cover 3 and cylinder head 2 and are separated from each other by a separation wall which, in this embodiment, is formed by the combination of the separation beam 35A with partition 35B. The separation wall is thus contained within the volume V defined between the cover 3 and cylinder head 2. Preferably, the two sub-volumes V1 and V2 are separated so as to avoid any leakage of fuel or oil from one sub-volume to the other.

In the shown design, the cap 3B comprises one part which extends over both of the sub-volumes V1 and V2. However, in an alternate design, the cap 3B could be made of multiple parts, for example two parts, which could be fitted each on top of the frame to close separately each one of the two sub-volumes V1 and V2. Such parts could be attached separately, and could therefore be removed separately.

In all cases, the cap 3B is preferably removable from the engine separately from the frame 3A. In other words, the cap 3B is preferably removable from the engine without removing the frame 3A.

The frame thus forms the lateral borders of the sub-volumes V1 and V2, but it is open towards the top to allow, after its own installation on the cylinder head, installation of various components, especially the installation of the high pressure fuel pipes 8 connecting the fuel accumulator to the injectors 7.

The frame 3A forms a part which is sandwiched between the cylinder head 2 and the cap 3B.

In an embodiment, as illustrated in FIG. 1, the injectors 7, the camshaft 15 and the rocker arm 10 are located inside the first sub-volume V1 and the common rail 6 is located inside the second sub-volume V2. The pipes 8 pass through a separation wall of the cover 3 in order to connect the common rail 6 to the connecting port 72 of each injector 7. Apertures 14 may be arranged in the separation wall of the cover so as to allow the pipes 8 to cross the separation wall 35A of the cover 3 and to extend for one part in the sub-volume V1 and for the other part in the sub-volume V2.

In the shown example, the apertures 14 are formed in the separation beam 35A of the frame 3A. Preferably, a sealing element is provided at the aperture to prevent leakage from one sub-volume to the other sub-volume. In a non-depicted embodiment, the apertures 14 for passing the pipes 8 through the separation wall may be arranged at the interface between the frame and the cap. The pipes 8 would then pass between the frame 3A and the cap 3B. A sealing element may be located around each pipe 8, between the frame 3A and the cap 3B, to separate the first sub-volume V1 from the second sub-volume V2. The sealing element provides a fluid tight sealing between the sub-volumes V1 and V2.

In some non-shown embodiments, the high pressure fuel pipes 8 may have a first portion extending in the first sub-volume V1 and a second portion extending in the second sub-volume V2. An annular seal may be fitted radially between the pipe 8 and the corresponding aperture 14 to prevent any leakage at the aperture. However, it could be that the first portion of the pipe in the first sub-volume is not further protected or sealed. In such a scenario, the fuel accumulator 6 would be well isolated in the second sub-volume V2, but a crack occurring at the first portion of the pipe or at the connection between the pipe and the injector may result in fuel spilling in the first sub-volume.

The embodiment shown in the figures has means to further improve the system. In this enhanced embodiment, an encapsulating element such as a hollow cylinder 9 is arranged around a first portion 82 of each pipe 8 extending between the separation wall and the connection port 72 of the injector 7. The encapsulating element is arranged around any part of the pipe 8 which would otherwise extend in the first sub-volume V1.

The encapsulating element, here the cylinder 9, goes through the separation wall, here the beam 35A, across the apertures 14. A sealing element is preferably installed between the beam 35A and each cylinder 9.

A first end 82.1 of the first portion 82 of each pipe 8 is connected on the connection port 72 of the injector 7, for example threaded on a threading of the connection port 72.

The encapsulating element 9 preferably extends so as to surround also the connection of the pipe on the connection port 72. In the shown embodiment, the encapsulating element 9 thus has a first extremity, on the side of the injector 7, which encapsulates the first end 82.1 of the first portion 82 of the corresponding pipe 8. A sealing element such as an O-ring 11 is preferably arranged between the connection port 72 and the first extremity of the corresponding cylinder 9 so that the internal volume of the encapsulating element is separated and sealed from the first sub-volume V1.

Preferably, the inside diameter of the first cylinder 9 is strictly greater than the outside diameter of the first portion 82 of the pipes 8, so that an empty volume V3 is delimited in the internal volume of the encapsulating member between each pipe 8 and the corresponding cylinder 9.

The encapsulating element 9, here the cylinder 9, has a second extremity on the side of the fuel accumulator 6, which extends in the second sub-volume V2. The second portion 82.2 of the pipe, which connects to the fuel accumulator 6, extends out of the internal volume V3 of the encapsulating element 9 through said second extremity. The second extremity may be open in such a way that the empty volume V3 is in fluid communication with the second sub-volume V2. The empty volume V3 can be considered as extending the second volume V2 up to the connection zone between the connection port 72 of the injector 7 and the pipe 8.

The O-ring 11 is preferably interposed between the outer surface of the connection port 72 and the inner surface of the cylinder 9, downstream the connexion between the connection port 72 and the first end 82.1 of the pipe 8, in the direction of fuel flow between the common rail 6 and the injector 7. This allows any fuel leakage at the connection between the first end 82.1 of the pipe 8 and the connection port 72 being collected in the empty volume V3 and being brought back to the second sub-volume V2.

The cylinder 9 passes through the separation wall 35A. The empty volume V3 can be considered as extending the second volume V2 beyond the separation wall 35A up to and including the connection zone between the injection port 72 and the pipe 8. Thanks to the empty volume V3, which is a sub-volume of the second sub-volume V2, the connection port 72 of the injector can be considered as being virtually located in the second sub-volume V2 so that any leak at this connection zone is collected into the second sub-volume V2.

The second extremity of the cylinder 9, which extends in the sub-volume V2, may be provided with a first nut portion 12, preferably fixed with the body of the cylinder 9, to allow bolting of the first extremity of the cylinder 9 on the connecting port 72 of the injector 7.

In an embodiment of the invention, not shown, the injector 7 and/or the separation wall could be designed so that the injector 7 is received within the first volume, except for its connecting port which would extend directly in the second sub-volume, through a suitable aperture in the separation wall. In such a case, the high pressure pipe connecting the fuel accumulator to the connecting port 72 would be entirely contained within the second sub-volume V2. Preferably the aperture in the separation wall would be formed at the interface between the frame and the cover. This would allow fitting first the frame to the cylinder head, then installing the injectors, the accumulator and the connecting pipes and finally closing the cover with the cap. The apertures could be in the shape of a lower half disc aperture in a top surface of the separation beam 35A of the frame and of a corresponding half disc aperture in a lower surface of the separation partition 35B of the cap. Such an embodiment would not require an encapsulation element. However, in a variant of such an embodiment, the frame and the cap of the cover could be formed such as to form an encapsulating portion having the same functionality, and possibly an equivalent shape, as that of the encapsulating element 9 described above. Preferably, such encapsulating portion could have a lower part integrated with the frame and an upper corresponding part integrated with the cap, so that, when the cap is fitted on the frame, it would form an encapsulating portion surrounding the first portion of the pipe.

Each pipe 8 may include a terminal portion 84 perpendicular to the first portion 82, here oriented upwards, so that the pipe 8 has an L-shape. The terminal portion 84 of the pipe 8 can be oriented to get in contact with the corresponding port of the common rail 6. A second nut 13 may be provided to connect the second portion 84 of each pipe 8 to the common rail 6 port.

In shown embodiment, the first and the second pipe portions which extend respectively in the first and the second sub-volumes are integral one with the other. However, the two portions could be formed of two separate pipe elements connected by a connector. Such connector would be part of the fuel connection. Such connector could be integrated in full or in pan in the separation wall.

With the invention, it is possible to have the entirety of the fuel connection between the fuel accumulator 6 and the injector 7 housed in the closed volume V bordered by the cover 3. Especially, the entirety of the high pressure pipe 8 is enclosed in the volume V defined between the cover 3 and the cylinder head 2. Of course, the fuel accumulator 6 and the injectors 7 are also housed in the volume V, with however a separation between the injectors which are in the first sub-volume and the fuel accumulator which is in the second sub-volume. At the same time, the two part construction of the cover allows an easy installation of the fuel injection system and makes maintenance easier.

As in the shown embodiment, the cap 3B of the cover 3 may be equipped with a service lid or trap-door 4 in order to allow access to the sub-volume V2 where is located the common rail 6, to perform maintenance. The trap-door 4 may be removable or hinged to the cap 3B. The trap-door 4 may be located so as to extend exclusively over the second sub-volume V2 so that opening of the trap-door 4 does not cause the opening of the first sub-volume V1. Thereby, the maintenance of the common rail 6 can be performed without removing the cover 3, i.e. neither the frame 3A nor the cap 3B, which saves time and improves the quality as the sealing element 30A between the cylinder head 2 and the cover 3 does not need to be removed. It is to be noted that the second volume is, in normal use, not filled with any fluid, so that the sealing requirement between the trap-door 4 and the cap 3B is not severe, and it may therefore not necessarily require a dedicated sealing element.

As in the shown embodiment, the height H1 of the beams 31A, 32A, 33A and 35A may be higher than the height H2 of the wall 34A. The first height H1 is high enough to allow the passage of the pipes 8. The second height H2 is low enough to allow an easy access to the second nut 13 when the cap 3B is off. It may also be of help for allowing easier insertion of the fuel connections, especially of the high pressure pipes 8, through the corresponding aperture in the separation wall. The second height H2 also allows the insertion of the cylinder 9 through the aperture 14. If a lid 4 is provided, the shape of the lid may be optimized to provide access to the first nut 12 in order to bolt the cylinder 9 on the connection port 72 of the injector.

When the cover 3 is fitted on the cylinder head 2, the first sub-volume V1 is sealed from the second sub-volume V2, which forms a common rail box.

In operation, the first sub-volume V1 may be filled with an oil mist for lubrication of the valve train mechanism.

In case of fuel leakages at the connection port 72 of the injectors 7, the cylinders 9 allow the fuel leaking from the connection port 72 to be collected in the empty volume V3 and gathered back in the second sub-volume V2. Thus, the fuel leakages cannot spray outside of the engine 1 and outside of the volume V defined by the cover 3 in an uncontrolled manner. Moreover the fuel leakages at the connection port 72 of the injectors 7 do not pollute the lubricating oil contained in the second sub-volume V1.

The second sub-volume may be equipped with a drain port to evacuate fuel, for example back to a fuel tank.

The invention allows collecting the fuel leakages from the most common defects, for example a crack in the pipes 8 or in the common rail 6, or a deficiency at the sealing point between the connection ports 72 and the pipes 8, or between the pipes 8 and the common rail 6, or around an optional non represented common rail pressure sensor.

Optionally, the engine assembly 1 may include a system for detecting the fuel leakages. For example, a fuel level sensor may be located in the second sub-volume V2 and/or a sensor may be located in the empty volume V3. This provides accurate leakage detection in an easy manner.

Thanks to the invention, the potential fuel leakages do not go outside the engine assembly 1, which eliminates safety and environment risks. The fuel leakages do not go in the engine oil, which eliminates the engine failure risks.

The common rail 6 and the pipes 8 can be serviced very quickly and independently from other components of the engine 1, in particular the valve train.

In the absence of any fuel leakage, the invention allows some common rail components such as sensors or valves to sit in a dry environment while being protected from the external environment. In this way, a good quality engine is provided with cheap components, such as connectors.

The fuel leakages can be easily detected, by mere visual inspection of the second sub-volume V2, or with sensors FS, which may be installed in the second sub-volume or in a drain line connected to the drain port.

The engine can be started with the trap-door 4 open, so that a visual leakage detection process is possible, in assembly plant or in workshop for service, in order to quickly check the tightness of the high pressure fuel system on the engine assembly 1, after assembly and before releasing the vehicle.

Additional components providing a noise shield or an acoustic treatment can be assigned to the second sub-volume V2 in order to decrease the overall noise emission.

A cooling function can be added to the common rail 6.

The drawings are based on a single overhead camshaft located on the exhaust side, but the invention is equally valid for double overhead camshaft layouts as the pipe 8 and nut 9 design allows reaching the injectors 7.

In the shown embodiment, the lower surface of the second sub-volume V2 which encloses the fuel accumulator 6 is formed by the top surface S2 of the cylinder head 2. However, it is conceivable that the frame 3A would have a lower wall extending throughout the contour B2 of the second sub-volume V2. In such a case the second sub-volume V2 could be entirely delimited by the cover 3, i.e. by the frame 3A and the cap 3B, including a potential lid 4 on the cap 3B.

The frame 3B may also have passages and or connectors for electric lines, e.g. for electric lines connecting the injectors to an electronic control unit.

The cover 3 may typically be made of plastic material, including fibre-reinforced plastic material. However, the different parts of the cover ma be made of different materials. For example, the frame 3A could be made of metal while the cap 3B could be made of fibre-reinforced plastic.

It is to be understood that the present invention is not limited to the embodiments described above and illustrated in the drawings; rather, the skilled person will recognize that many changes and modifications may be made within the scope of the appended claims.

The invention claimed is:

1. Cover for an internal combustion engine assembly comprising a pressurized fuel accumulator feeding fuel to at least one injector, the cover defining, with a cylinder head, a volume designed to receive the pressurized fuel accumulator and the injector, the cover bordering a first sub-volume, designed to receive the injector, and a second sub-volume separated from the first sub-volume by a separation wall of the cover and designed to receive the pressurized fuel accumulator, wherein the cover includes a frame to be fitted on the cylinder head and a cap removably fitted on the frame, and wherein the separation wall is designed for the passage of a fuel connection connecting the injector to the pressurized fuel accumulator, wherein the frame defines a first contour of the frame bordering the first sub-volume and a second contour of the frame bordering the second sub-volume, wherein the cap includes walls defining a first contour of the cap coinciding with the first contour of the frame and a second contour of the cap coinciding with the second contour of the frame, and wherein, when the cap is assembled to the frame, the first contour of the cap and the first contour of the frame match to define the first sub-volume and the second contour of the cap and the second contour of the frame match to define the second sub-volume.

2. Cover according to claim 1, wherein the separation wall comprises an aperture for the passage of the fuel connection from the first sub-volume to the second sub-volume.

3. Cover according to claim 2, wherein the aperture is entirely formed in a portion of the separation wall pertaining to the frame.

4. Cover according to claim 2, wherein the aperture is formed at an interface between the frame and the cap.

5. Cover according to claim 1, wherein a height of at least one beam defining the first contour of the frame is higher than a height of at least one beam defining the second contour of the frame.

6. Cover according to claim 1, wherein the cap includes a service trap-door opening into the second sub-volume.

7. Cover according to claim 1, wherein the cap includes an integral cover wall.

8. Cover according to claim 1, wherein the cap includes a removable cover wall.

9. Internal combustion engine assembly, wherein the engine assembly includes a pressurized fuel accumulator feeding fuel to at least one injector, a cylinder head and a cover according to claim 1.

10. Internal combustion engine assembly comprising a pressurized fuel accumulator feeding fuel to at least one injector, a cylinder head and a cover, the cover defining, with the cylinder head, a volume enclosing the pressurized fuel accumulator and the injector, and the cover bordering a first sub-volume enclosing the injector, and a second sub-volume separated from the first sub-volume by a separation wall of the cover and enclosing the pressurized fuel accumulator, wherein the cover includes a frame fitted on the cylinder head and a cap removably fitted on the frame, wherein a fuel connection connecting the injector to the pressurized fuel accumulator passes through the separation wall, wherein the separation wall is extended by an encapsulating element designed to be arranged around the fuel connection in a configuration where the encapsulating element defines an empty volume around the fuel connection, the empty volume extending the second volume up to a connection zone between a connection port of the injector and the fuel connection.

11. Internal combustion engine assembly according to claim 10, wherein a sealing element is located between the cylinder head and the frame.

12. Internal combustion engine assembly according to claim 10, wherein the encapsulating element has the shape of a cylinder having an extremity attached to the connecting port of the injector.

13. Internal combustion engine assembly according to claim 10, wherein a fuel sensor is located in the second sub-volume.

14. Internal combustion engine assembly according to claim 10, wherein the fuel connection includes a pipe having a first portion connected to a connection port of the injector and a terminal portion globally perpendicular to the first portion and connected to the pressurized fuel accumulator.

15. Automotive vehicle, wherein the vehicle includes an internal combustion engine assembly according to claim 10.

* * * * *